US006085553A

United States Patent [19]

Schmidt et al.

[11] Patent Number: 6,085,553

[45] Date of Patent: Jul. 11, 2000

[54] METHOD FOR PRODUCING A KNITTED ARTICLE ON A FLAT KNITTING MACHINE

[75] Inventors: Henning Schmidt; Wolfgang Schwarz, both of Reutlingen; Juergen Schwenk, Hechingen; Oliver Vogt, Reutlingen, all of Germany

[73] Assignee: H. Stoll GmbH & Co., Reutlingen, Germany

[21] Appl. No.: 09/037,944

[22] Filed: Mar. 10, 1998

[30] Foreign Application Priority Data

Mar. 10, 1997 [DE] Germany ..... 197 09 695

[51] Int. Cl.[7] ..... D04B 7/00; D04B 1/00

[52] U.S. Cl. ..... 66/69; 66/170

[58] Field of Search ..... 66/60 R, 64, 69, 66/170, 171, 173, 175, 176

[56] References Cited

U.S. PATENT DOCUMENTS 4,005,494 2/1977 Burn ..... 66/173
5,259,209 11/1993 Mitsumoto et al. ..... 66/173
5,321,959 6/1994 Mitsumoto ..... 66/173
5,361,607 11/1994 Mitsumoto et al. ..... 66/173

*Primary Examiner*—Danny Worrell
*Attorney, Agent, or Firm*—Michael J. Striker

[57] ABSTRACT

A method for producing a knitted article on a flat knitting machine with two opposite needle beds and a stitch hanging over device has the steps of providing a knitted article with a base knitted structure and at least one parallel partial knitted texture which partially overlaps the base knitted structure, equipping at least in a region of the parallel partial knitted structure at most each second needle of one needle bed with a stitch of the base knitted texture, emptying a needle of another needle bed which is opposite to the equipped needle of the one needle bed, producing stitches of at least one parallel partial knitted texture in needles which are not equipped with base knitting stitches, hanging over stitches of the base knitted texture in a region of at least one parallel partial knitted texture before producing of stitches for the parallel partial knitted texture on the other needle bed.

7 Claims, 17 Drawing Sheets

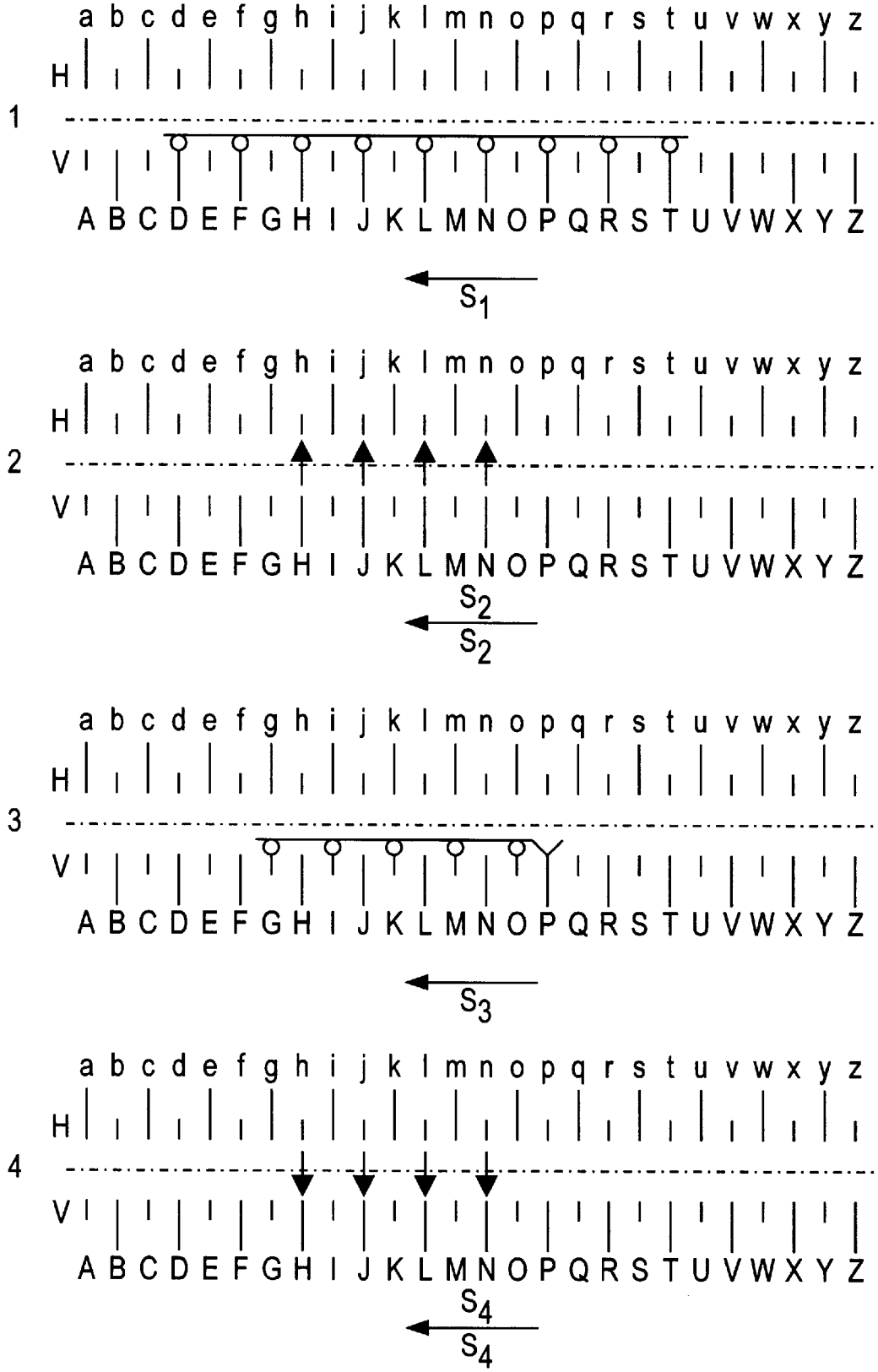
FIG. 2.1

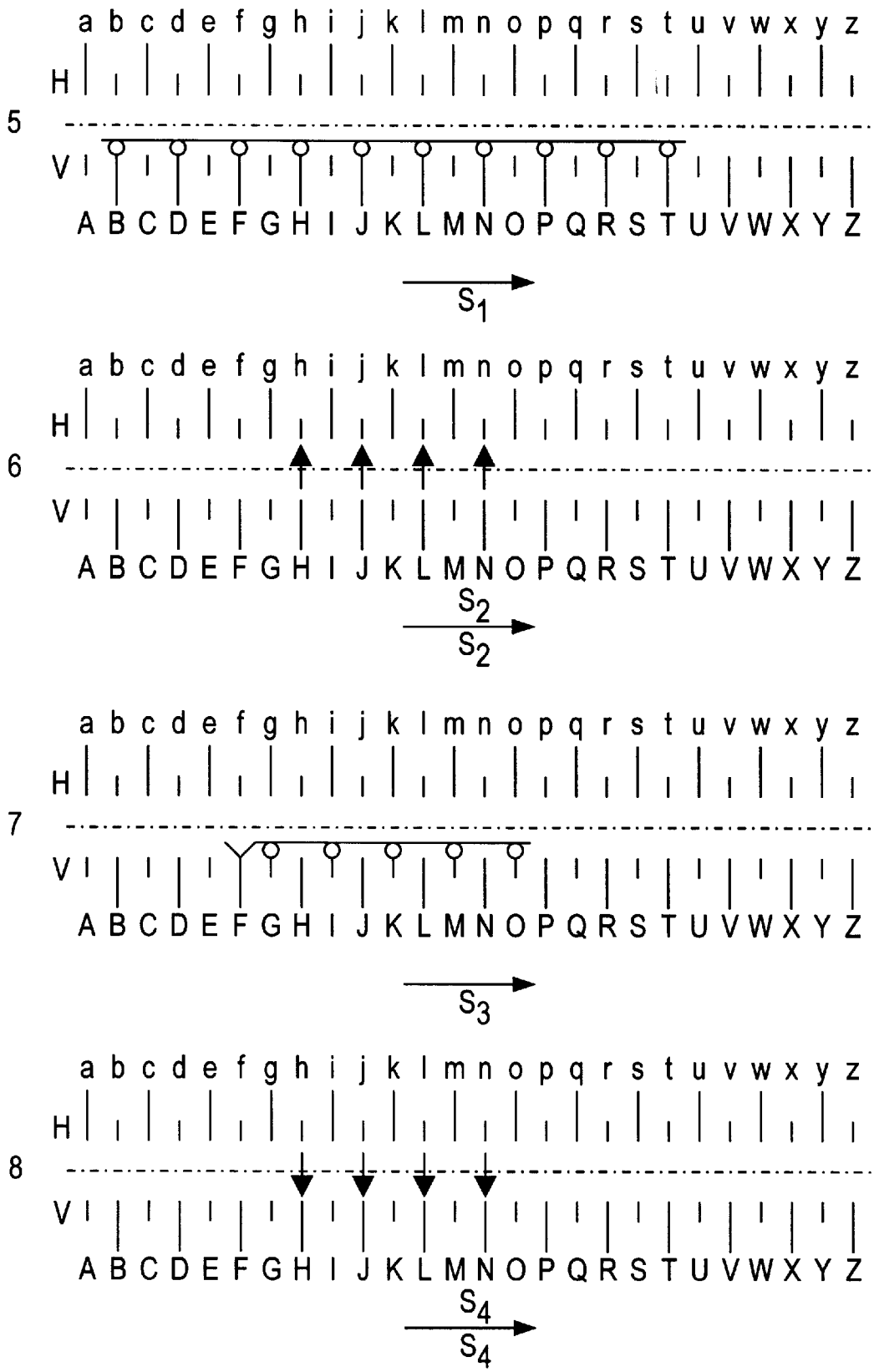
FIG. 2.2

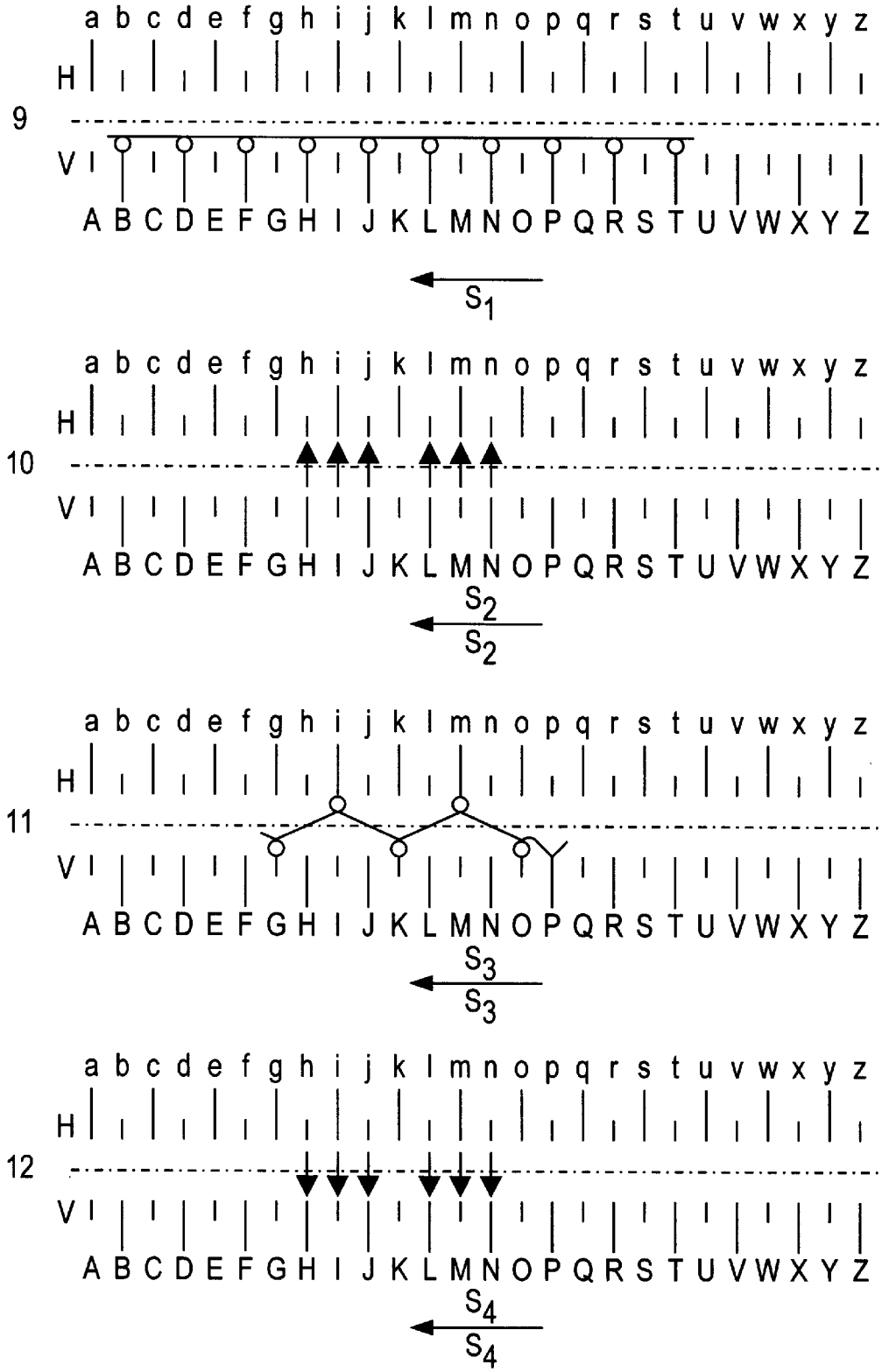
FIG. 2.3

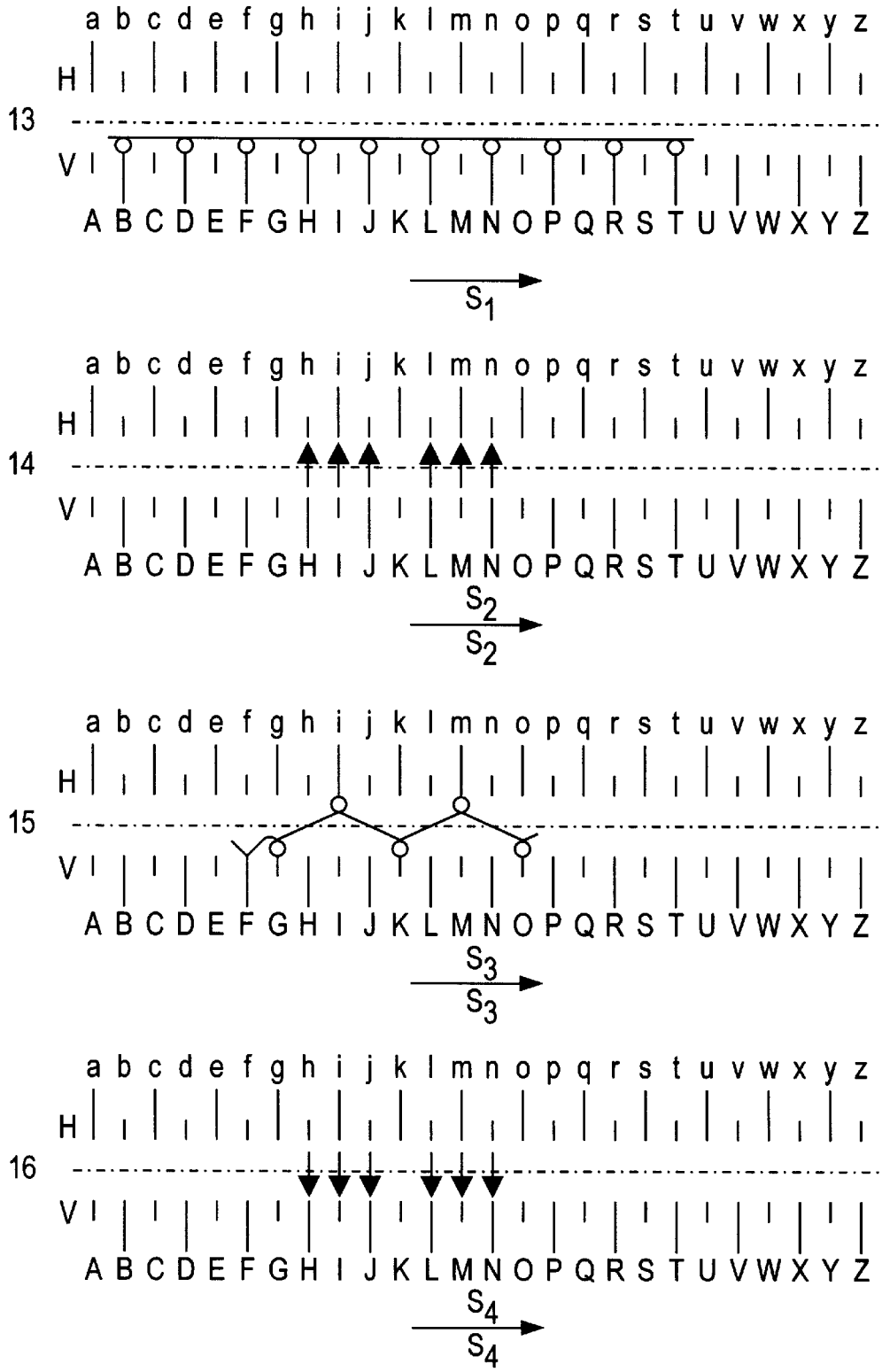
FIG. 2.4

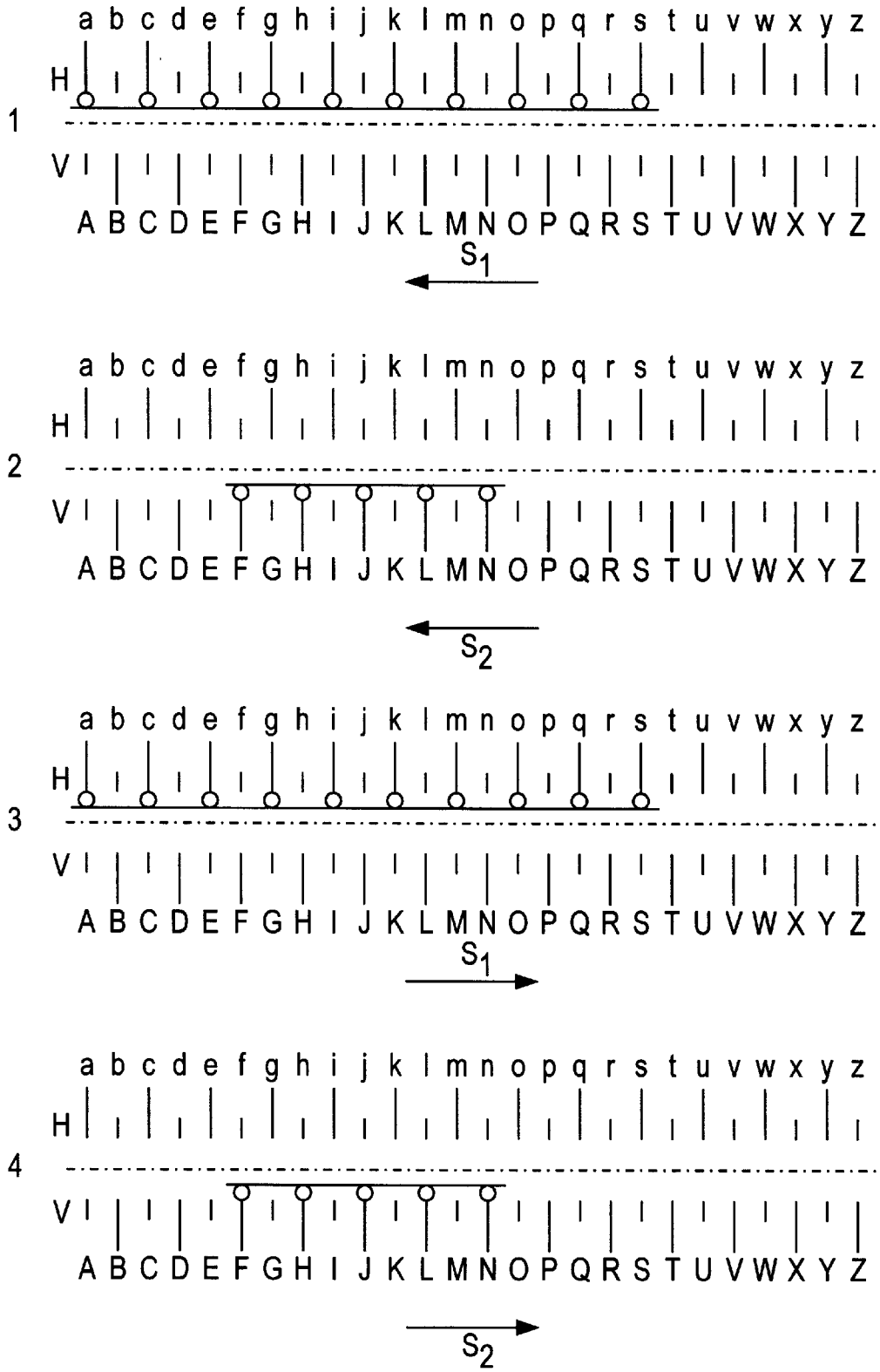
FIG. 4.1

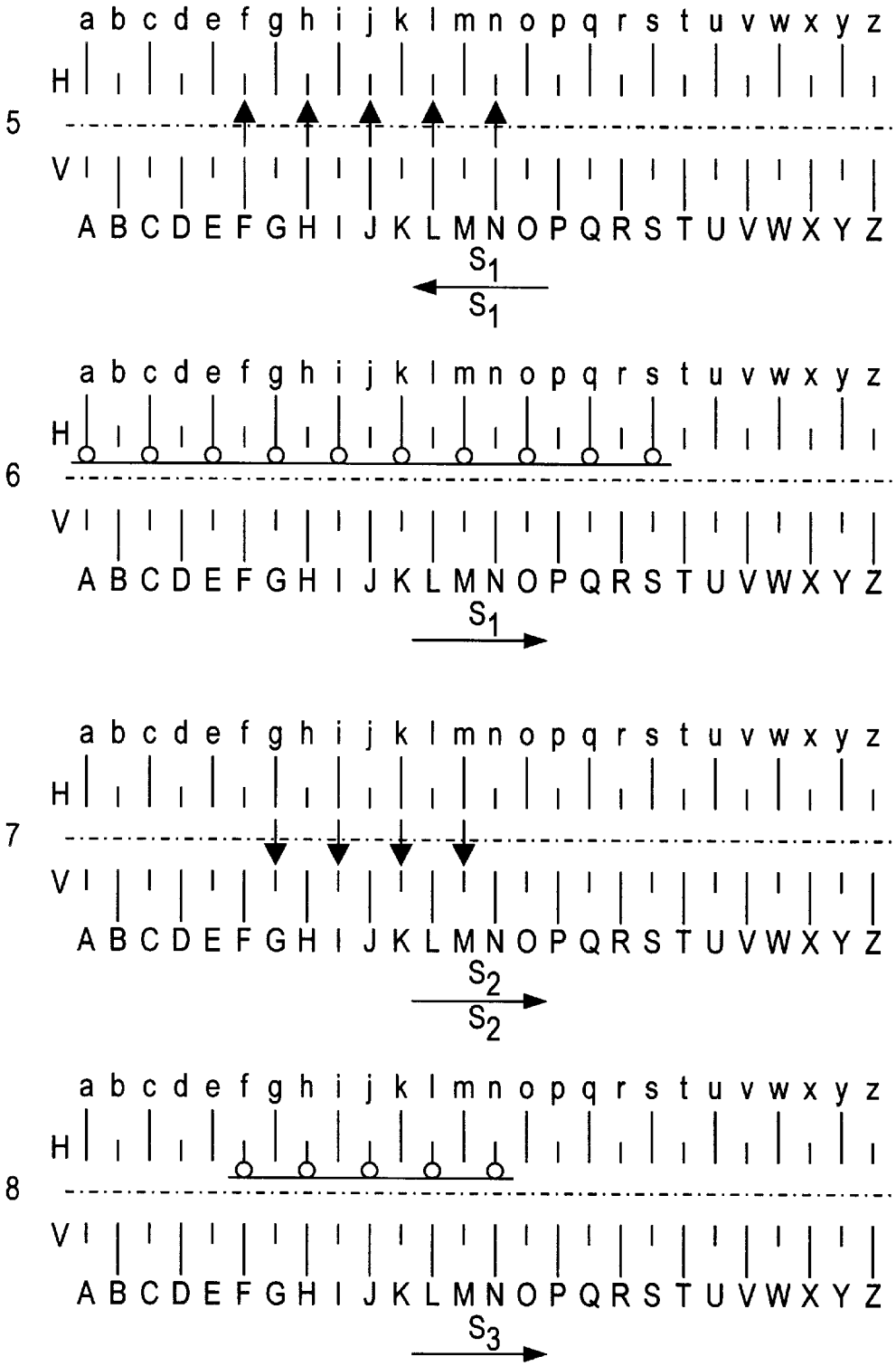
FIG. 4.2

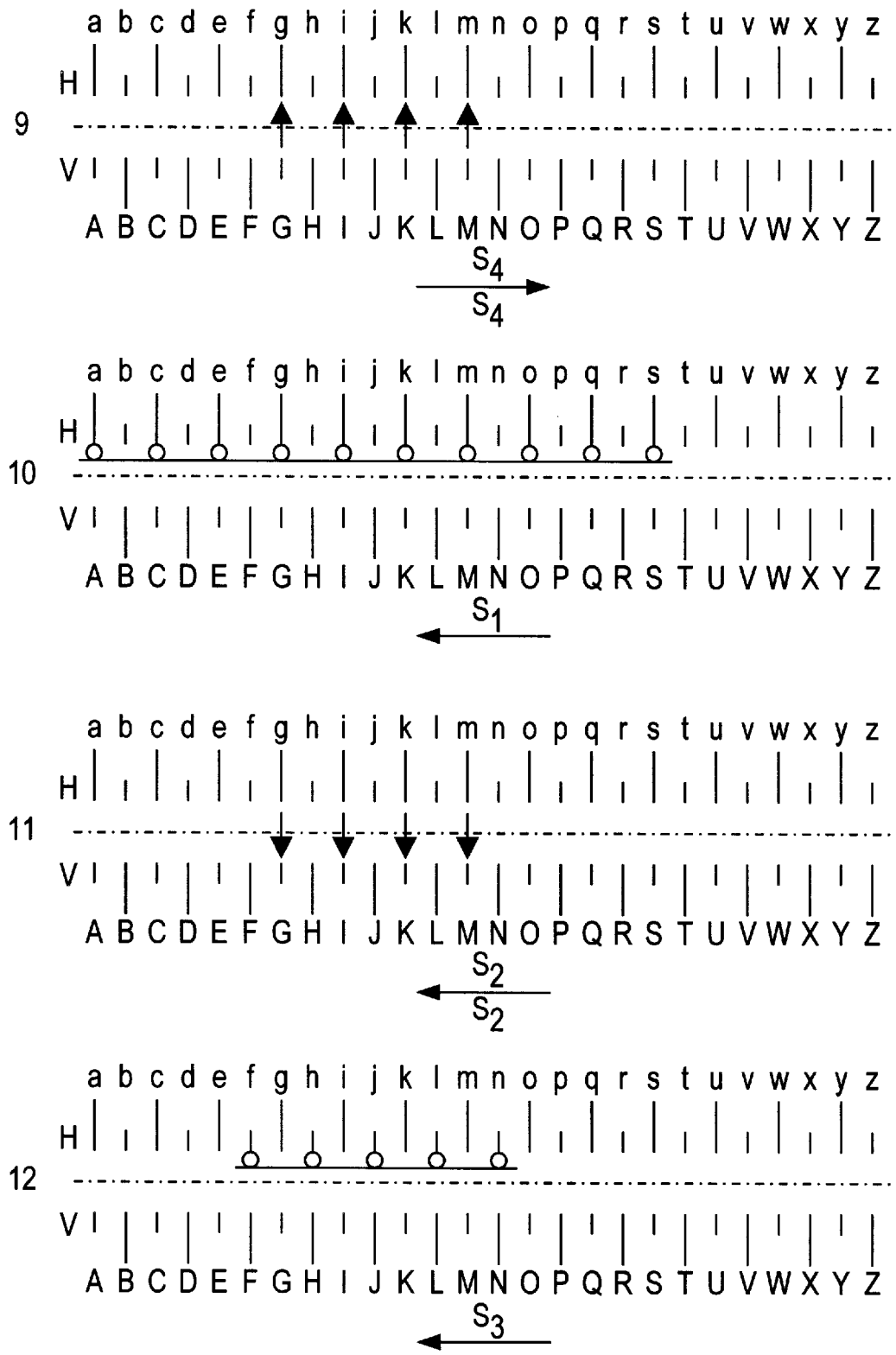
FIG. 4.3

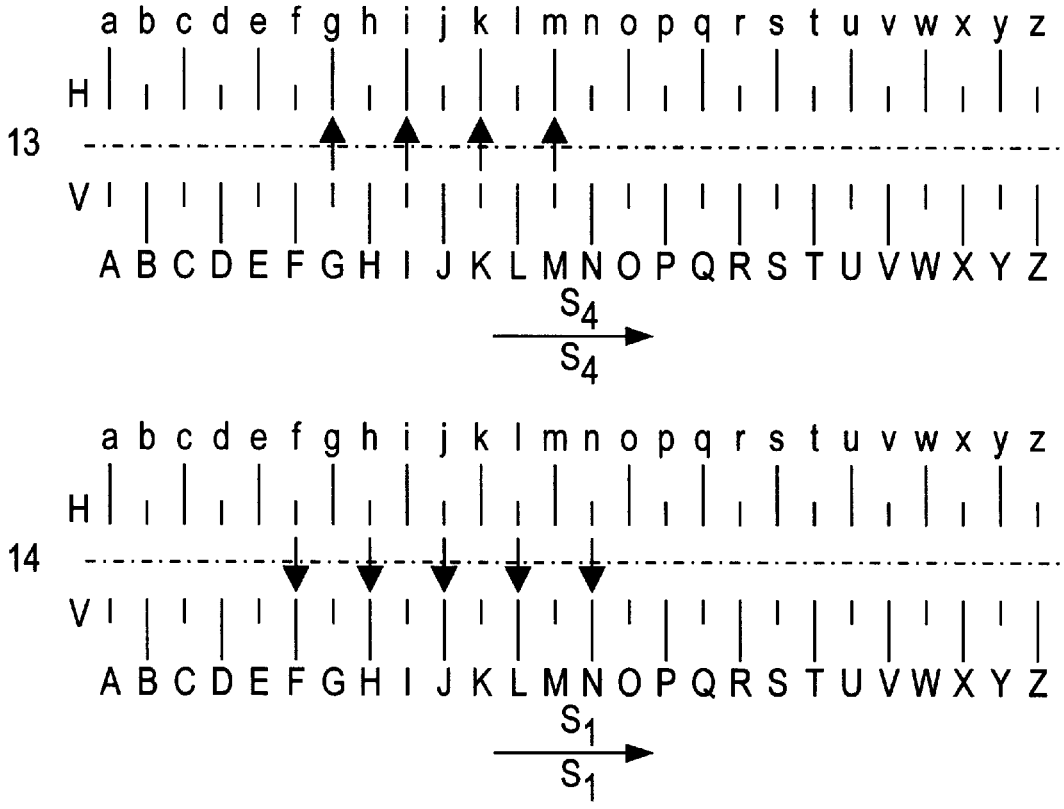
FIG. 4.4

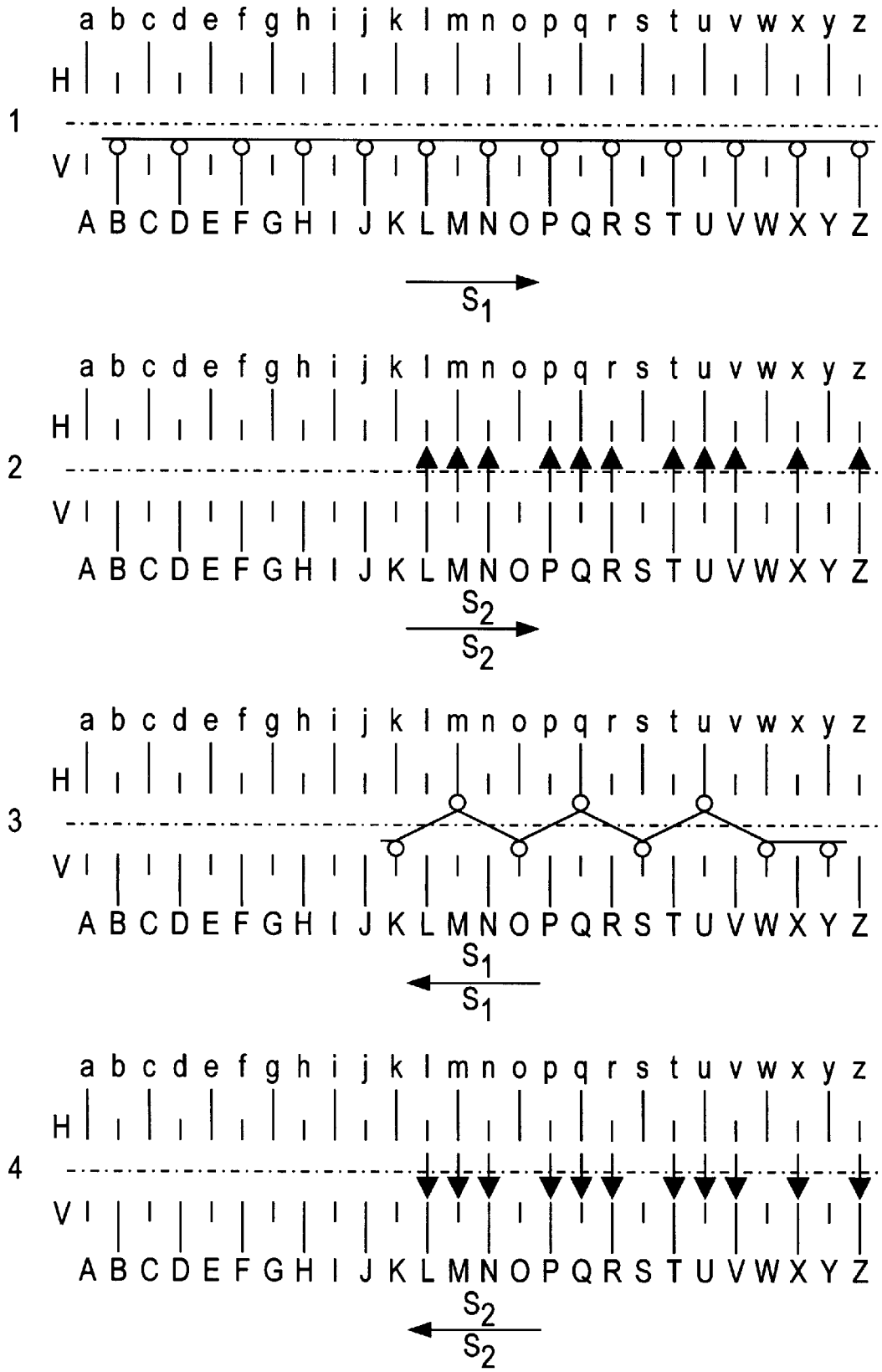
FIG. 6.1

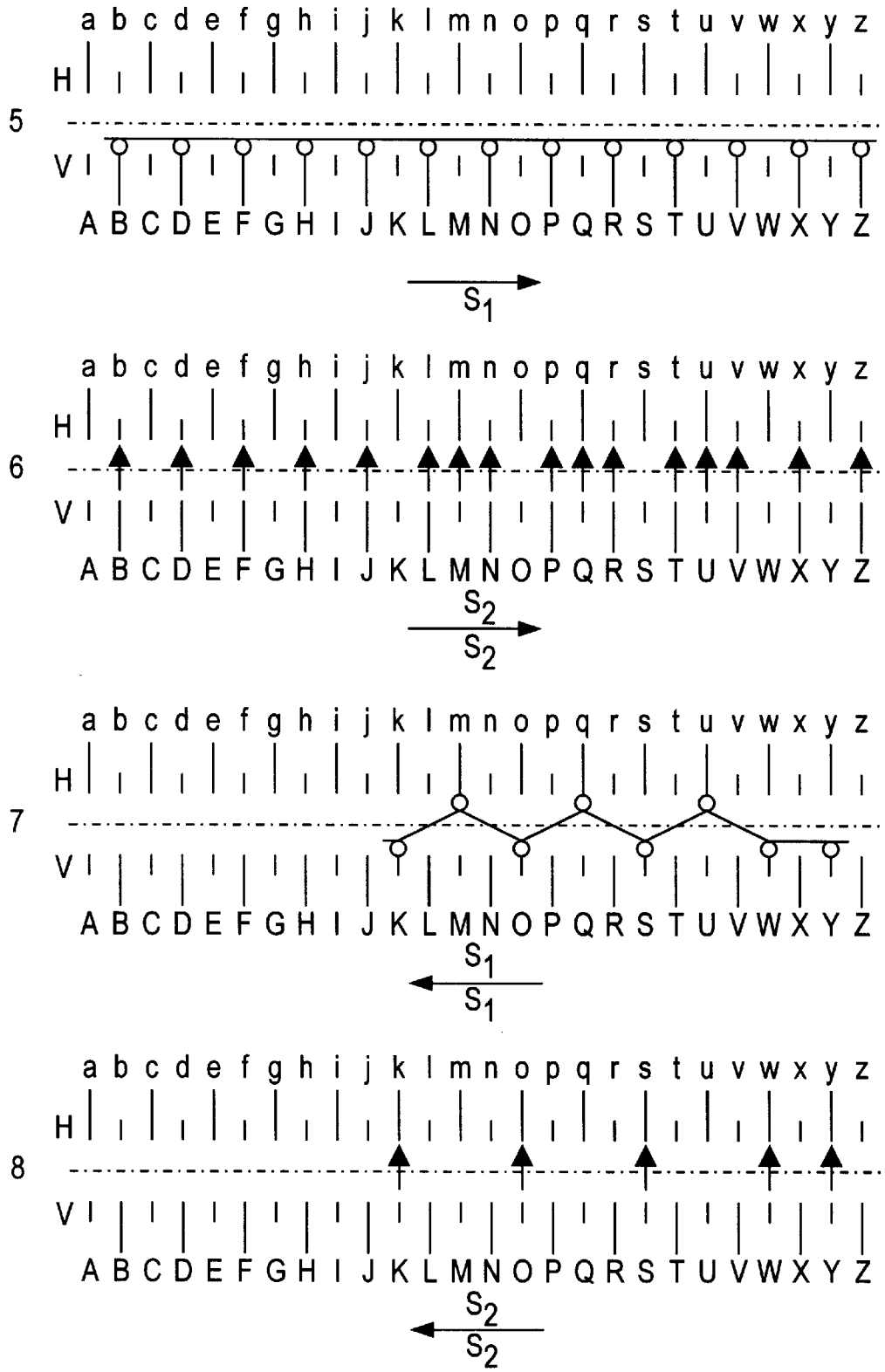
FIG. 6.2

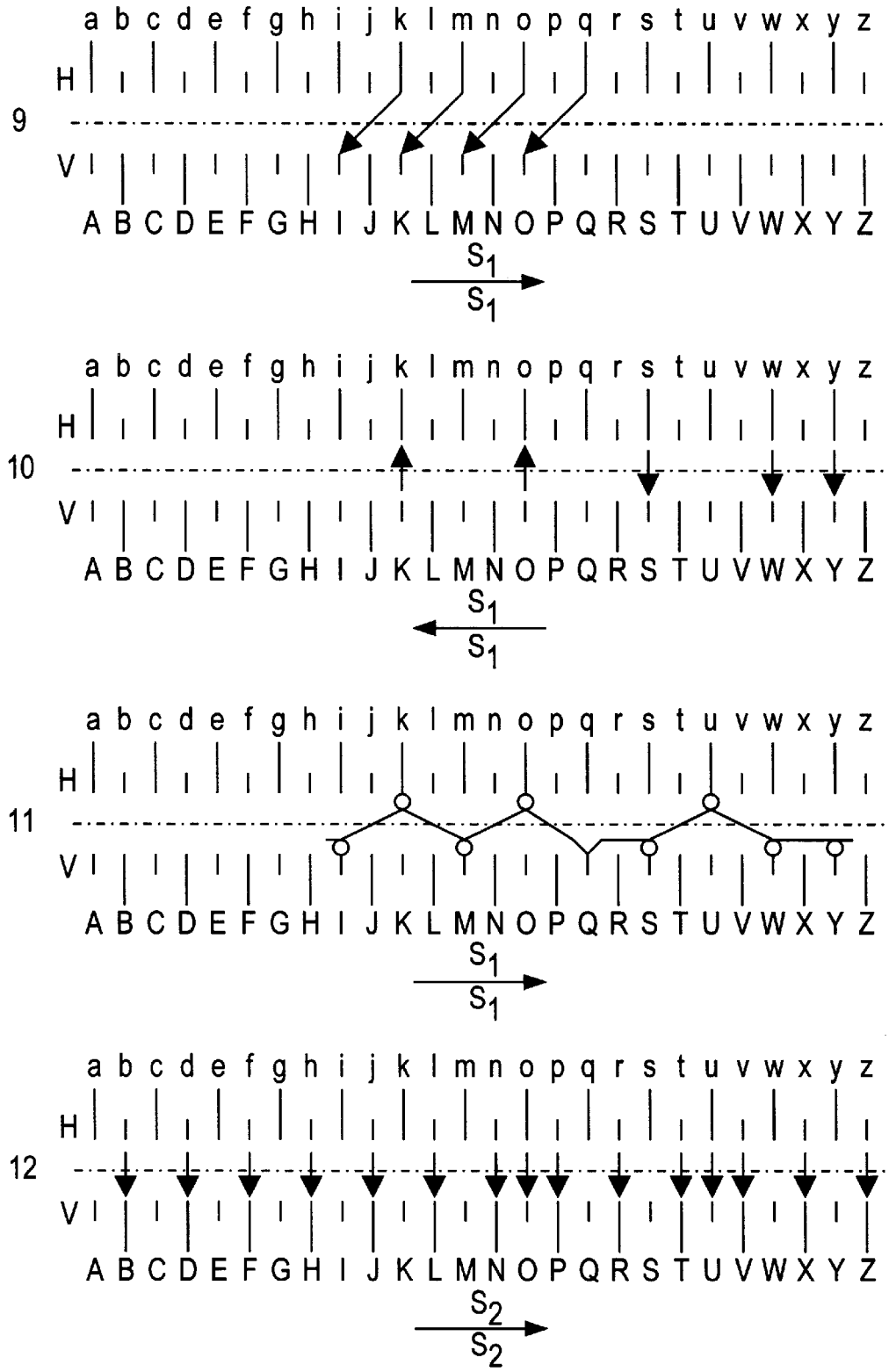
FIG. 6.3

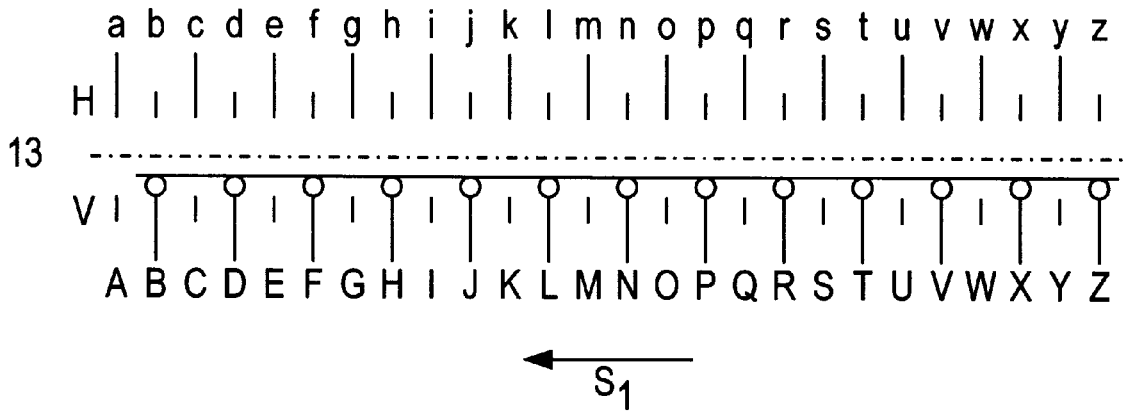
FIG. 6.4

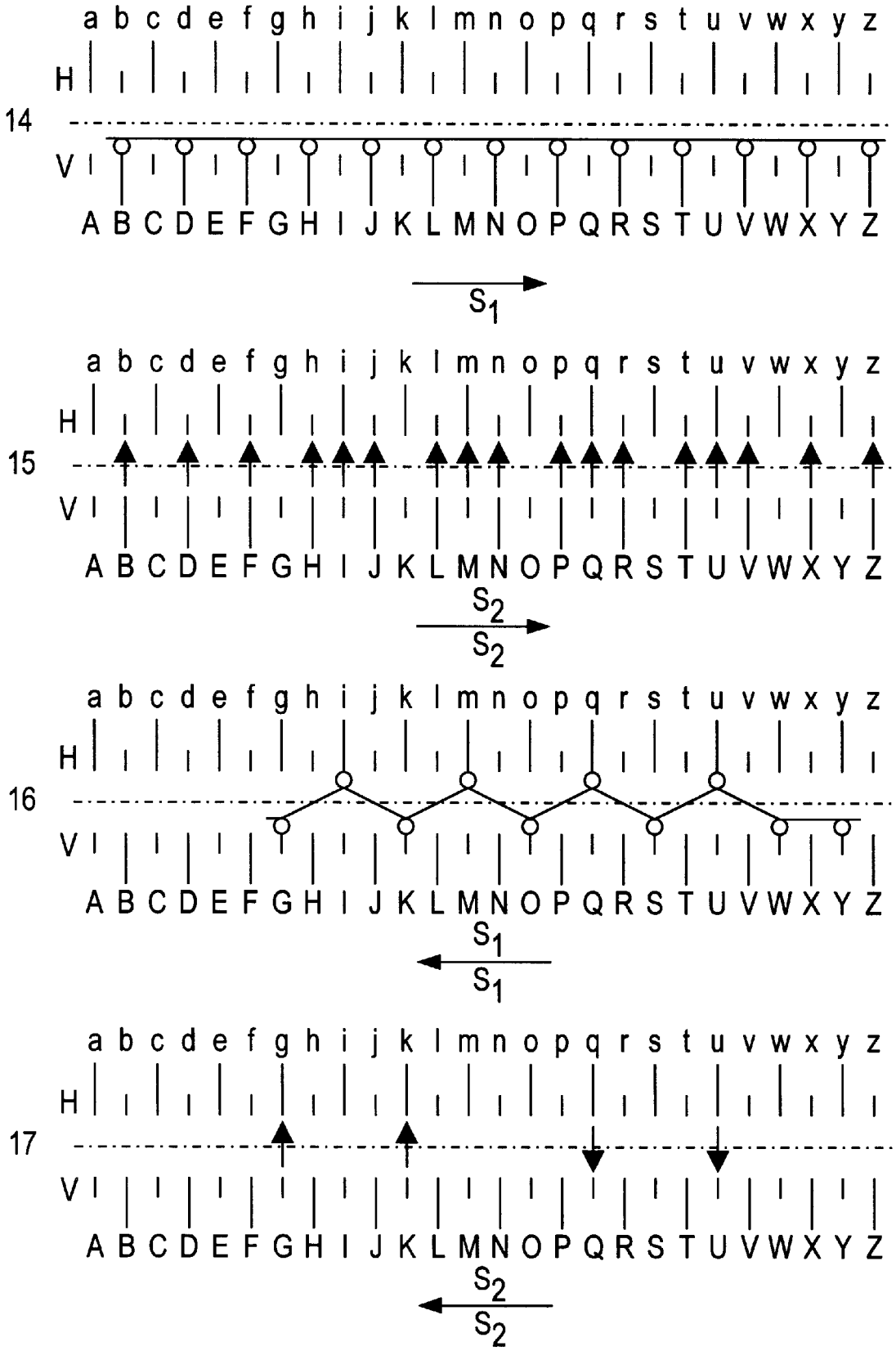
FIG. 6.5

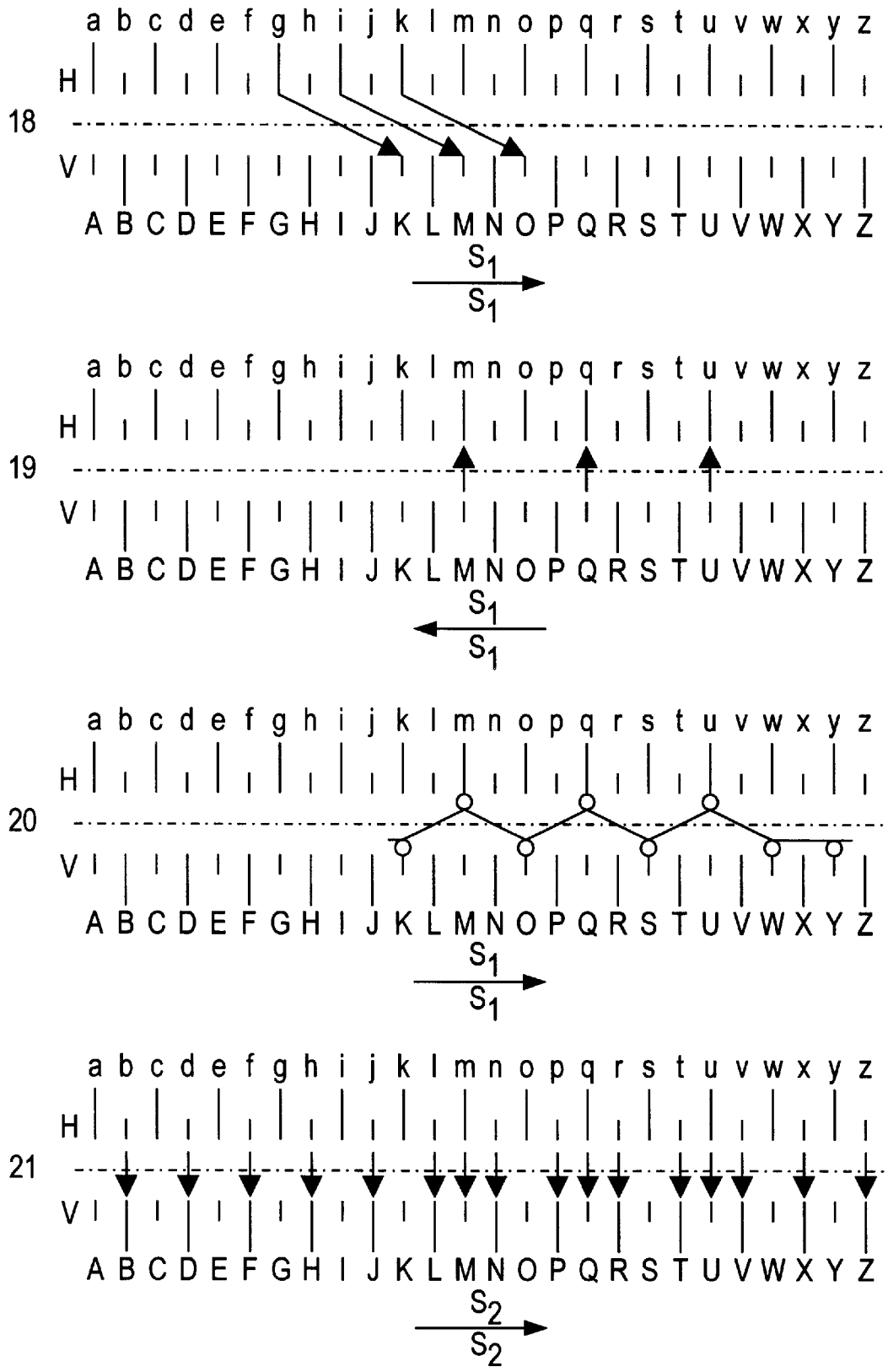
FIG. 6.6

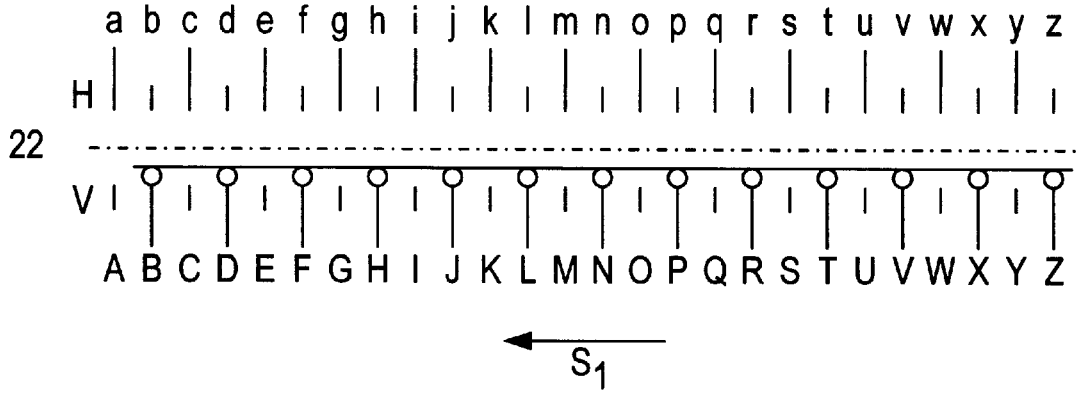
FIG. 6.7

METHOD FOR PRODUCING A KNITTED ARTICLE ON A FLAT KNITTING MACHINE

BACKGROUND OF THE INVENTION

The present invention relates to a method for producing a knitted article on a flat knitting machine.

In particular for clothing articles with pockets or collars or with special pattern effects, the parallel production of a base knitted texture and a partial knitted texture is desired. Also, no limitation must be imposed for the utilized formation technique for the basic and partial knitted textures. Known knitting processes could not satisfy these requirements. It is however known to produce pockets by a hose round knitting technique, so that the basic knitted texture with this technique has left stitches in the region of the pocket rear base, which distorts the optical impression of the knitted product since the pockets mainly slightly protrude, so that also the pocket background is seen.

In accordance with another process, the pockets are produced as hose-shaped dents of the base knitted texture, whose side edges are sewn together later, which leads to high manufacturing expenses.

SUMMARY OF THE INVENTION

Accordingly, it is an object of present invention to provide an improved for producing a knitted article on a flat knitting machine.

In keeping with these objects and with others which will become apparent, in order to avoid the above mentioned limitations, a method is proposed for producing a knitted article on a flat knitting machine with two opposite needle beds and a loop transfer device, in which a knitted article has a base knitted texture and at least one parallel partial knitted texture overlapping partially the base knitted texture, and at least in the region of the parallel partial knitted texture or textures at most each second needle of a needle bed is provided with a stitch of the base knitted texture and a knit-provided needle of the needle opposite to one needle bed of the other needle bed is empty, and the stitches of at least one parallel partial knitted texture are produced in the needles which are not provided with the base knitting stitches and the stitches of the base knitted texture in the region of at least one parallel partial knitted texture before the production of stitches for the parallel partial knitted texture are transfer on the other needle bed.

With this method, parallel partial knitted textures can be formed at any point on the base knitted textures. The base knitted texture can have any known structure or color pattern, which can be knitted with the needle division of the inventive method. The formation techniques can vary over the surface of the base knitted texture. The same is true for the parallel partial knitted texture produced with the inventive method. Also, the geometrical shape of the base knitted texture and the parallel partial knitted texture is completely arbitrary. The parallel partial knitted textures can be produced both on the front side and on the rear side of the base knitted texture, and connected at least at one point with the base knitted texture. The connection with the base knitted texture can be performed by tuck loops. Therefore the connections can be produced both along the edges of the parallel partial knitted texture and also with punctual connections.

The inventive method can be varied so that inventive method parallel partial knitted textures can be produced, which have a rib knitted region as well as parallel partial knitted texture which are formed as strip-shaped, plane rib knitted textures which are alternatingly appear on the front and rear side of a base knitted texture. In accordance with a further feature of the present invention, the inventive method can produce a base knitted texture with a parallel knitted texture, a right-right knitted texture with regions of constant knitting width, regions knitting expansion and regions of a knitted width reduction.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a view showing a stitch course for producing the knitted article of FIG. 1;

FIG. 4 is a view showing a stitch course for producing the knitted article of FIG. 3;

FIG. 6 is a view showing a stitch course for producing of individual regions of the knitted articles of FIG. 5.

DESCRIPTION OF PREFERRED EMBODIMENTS

Figure 1:
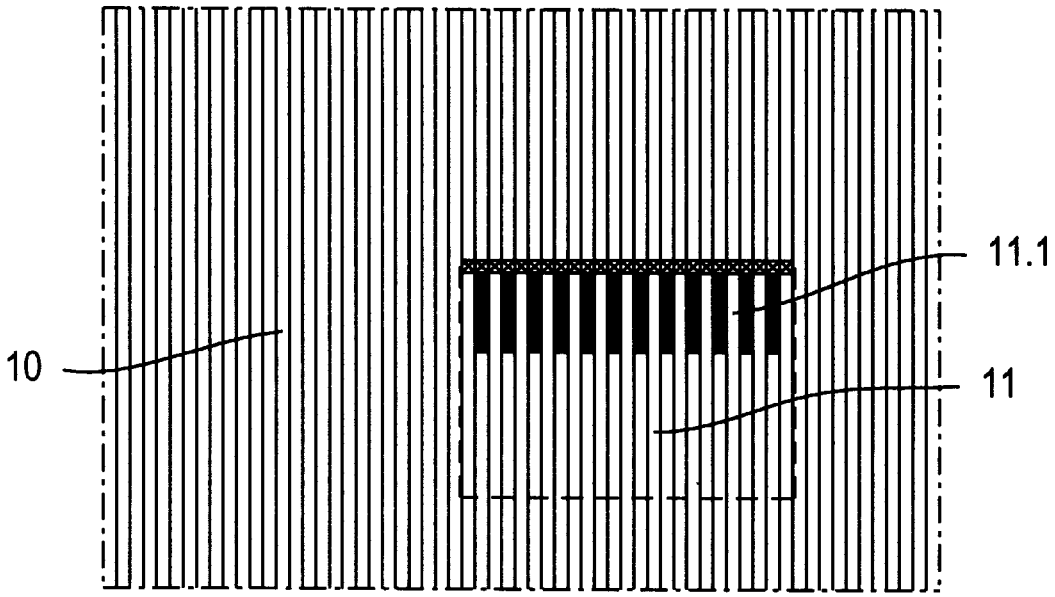
FIG. 1 is view schematically showing a knitted article with a pocket formed as a parallel partial knitted texture.

FIG. 1 shows a base knitted texture 10, for example a plane right knitted texture, with a pocket 11 provided on its front side and formed also as a plane right knitted texture. The upper edge 11.1 of the pocket 11 is formed as a rib knitted texture. The whole pocket 11 is produced as a parallel partial knitted texture to the base knitted texture 10, and the method which is used is shown in FIG. 2 as to its stitch courses. In row 1 the right stitches of the base knitted textures is formed with needles B, D, F, H, J, L, N, P, R, T in the knitting direction from right to left with a first knitting system S1. Thereafter, in row 2 in the same knitting direction the stitches of the base knitted structure H, J, L, N are dropped in the region of the parallel partial knitted textures of the rear needle bed with the second knitting system S2. In row 3, right stitches are formed with the needle G, I, K, M, O for the parallel partial knitted structure in a carriage direction from right to left with a third knitting system S3. The needle P produces a tuck, whereby the parallel partial knitted structure is connected to the base knitted structure. In row 4, a back hanging of the stitches of the base knitted structures on the needles of the front needle bed is performed.

In the rows 5–8, the same knitting course is performed as in the rows 1–4 in the knitting direction from left to right. The process can be repeated until the desired height of the parallel partial knitted structure, here the pocket 11 is obtained as a plane right knitted structure. In the rows 9–16 the production of the rib knitted edge 11.1 of the pocket 11 is presented. In the row 9 first again a stitch row for the base knitted texture is performed in the knitting direction from right to left with the first knitting system S1. Then the stitches H, J, L, N of the base knitted structure in the region of the parallel partial knitted structure as well as the left stitches I, M of the parallel partial knitted texture are hungover. In row 11, the right and left stitches are parallel partial knitted texture, whereby the rib structure of the edge 11.1 of the pocket 11 is produced. The needle P forms again a tuck loop for binding the pocket 11 on the base knitted texture. In row 12 the stitches of the base knitted texture h, j, l, n as well as the left links of the parallel partial knitted textures i, m are hung back from the rear needle bed H, to the front needle bed V. Subsequently, in the rows 13–16 the same knitting process is performed as in the rows 9–12 in a reverse carriage direction from left to right. The steps of the rows 9–16 are repeated until the rib edge 11.1 of the pocket 11 reaches a desired height.

Figure 3:
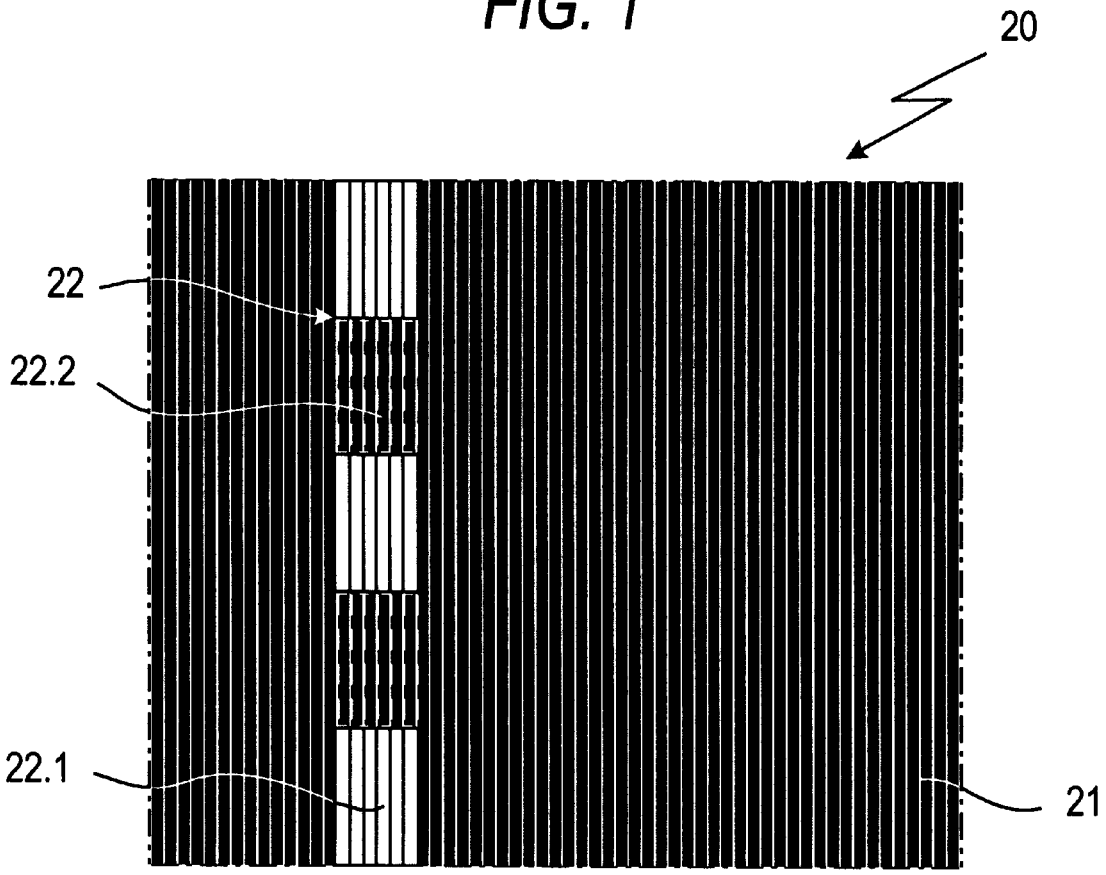
FIG. 3 is a schematic view of a knitted article with a band-shaped parallel partial knitted texture which alternatingly extends on the front side and the rear side of the base knitted texture.

FIG. 3 shows a knitted article 20 with a special effect pattern which is formed by a smooth left knitted base surface 21 on which a band-shaped parallel partial knitted texture 22 is arranged. Wherein the parallel partial knitted texture extends on a visible side of the plane right knitted texture and alternatingly in the regions 22.1 on the front side of the base knitted texture 21 and in the regions 22.2 on the rear side of the base knitted texture 21. The stitch course shown in FIG. 4 deals with a high register of the base knitted texture 21 with a region 22.1 and a region 22.2 of the band-shaped parallel knitted texture 22. First in row 1, a stitch row for the base knitted texture 21 is formed on the rear needle bed H with a first knitting system S1 in the carriage direction from right to left. Then in row 2 in the same carriage direction a right stitch row for the parallel partial knitted texture 22 is produced with a second knitting system S2. In row 3 a stitch row formation for the base knitted texture in the carriage direction from left to right is performed, before in row 4 again a stitch row for the parallel partial knitted texture is formed on the front needle bed V. The steps of the rows 1–4 are subsequently repeated until the desired height of the region 22.1 of the parallel partial knitted texture 22 is obtained on the front side of the base knitted texture 21.

Then in row 5 all stitches F, H, J, L, N of the parallel partial knitted texture 22 are transfer from the front needle bed V to the rear needle bed H whereby the parallel partial knitted texture 22 alternates on the rear side of the base knitted texture 21. Subsequently in row 6 a stitch row for the base knitted texture 21 is produced on the rear needle bed. Then in row 7 the stitches g, i, k, m of the base knitted texture 21 in the region of the parallel partial knitted texture 22 are transfer from the rear needle bed H to the front needle bed V, and in row 8 with a third knitting system S3 a stitch row is produced for the region 22.2 of the parallel partial knitted texture 22 in the carriage direction from left to right. In row 9, the stitches of the base knitted texture 21 are again transfer from the rear needle bed H and in row 10 a stitch row for the base knitted texture 21 can be produced on the rear needle bed in the carriage direction from right to left. Subsequently the stitches g, i, k, m of the base of the knitted texture 21 are transfer from the rear needle bed H to the front needle bed V, and then a stitch row for the parallel partial knitted texture 22 is produced on the rear needle bed H in row 12. In row 13 again a return hanging of the stitches of the base knitting texture 21 is performed on the rear needle bed H. The steps shown in rows 6–13 can be repeated until the region 22.2 of the parallel partial knitted texture 22 reaches on the rear side of the base knitted texture 21 a desired height. Subsequently the stitches of the parallel partial knitted texture f, h, j, l, n, as shown in row 4, are transfer from the rear needle bed H to the front needle bed V, whereby the parallel partial knitted texture 22 again alternates on the front side of the base knitted texture 21. By the repeated performance of the steps in accordance with FIG. 4, the pattern register of the parallel partial knitted texture can be repeated as often as desired.

Figure 5:
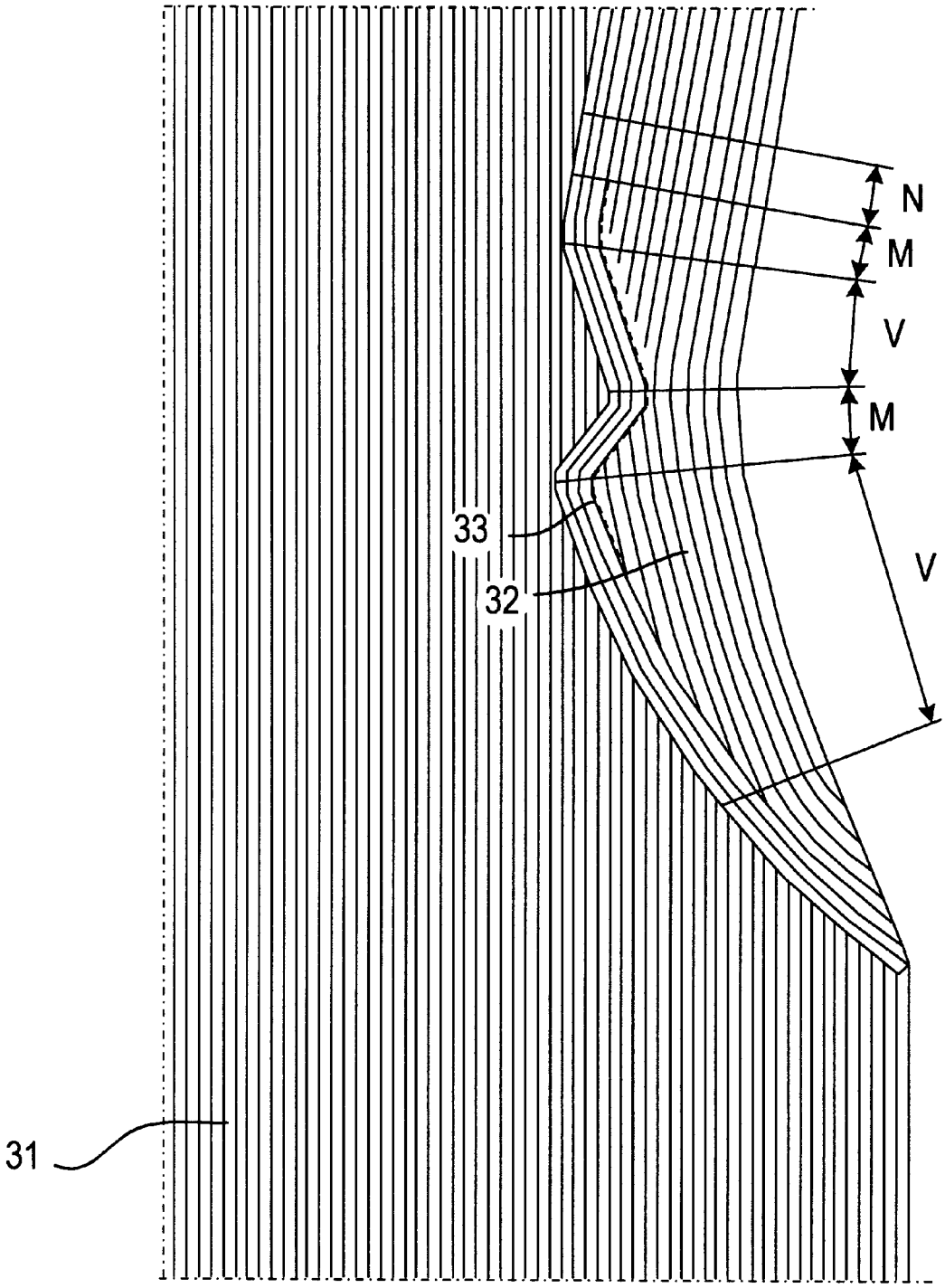
FIG. 5 is a view schematically showing a knitted article with a reverse collar which is formed as a parallel partial knitted texture.

FIG. 5 shows a knitted article 30 which is composed of a smooth knitted base knitted texture 31 and a reverse collar 32 produced as a right-right parallel partial knitted texture for the base knitted texture 21. The reverse collar 32 is assembled of regions with a knitted expansion V, regions with a knitted width reduction M and regions with constant knitting width N. In the regions V and M the expansion or width reduction are performed not directly at the left edge but instead substantially offset as shown in a broken line 33. FIG. 6 describes the production of the individual regions N, V and M of the reverse collar 32. In the rows 14 first the production of a region N with a constant knitting width is illustrated by the stitch course. In row 1 a stitch row of the base knitted texture is formed on the front needle bed V in the knitting direction from left to right with the first knitting system S1. Subsequently in row 2, the stitches L, N, P, R, T, V, X, Z of the base knitted texture 31 are formed with the second knitting system S2 in the region of the parallel knitted reverse collar 32 as well as left stitches M, Q, U of the parallel partial knitted texture 32 are transferred from the needle bed V to the rear needle bed H. Therefore in row 3 left and right stitches are formed for the parallel partial knitted structure 32 with the first knitting system S1 in the carriage direction from right to left. The needle Y carries a connection stitch for the base knitting texture 31, or in other words for the stitch of the needle Z. In row 4 the stitches l, n, p, r, t, v, s, z of the base knitted texture 31 and also the left stitches m, q, u are hang back to the front needle bed 8. The steps of the rows 1–4 can be repeated until the region N has the desired length.

The production of a region V with an extension of the parallel partial knitted texture 32 are shown in the rows 5–13. In row 5 a stitch row for the base knitted texture 31 is formed on the front needle bed V from left to right in the carriage direction with the first knitting system S1. Subsequently in the same carriage direction with the knitting system S2, all stitches of the base knitted texture 31 as well as the left stitches M, Q and U of the parallel partial knitted texture 32 are transfer from the front needle bed V to the rear needle bed H in row 6. In row 7 the formation of the right and left stitches for the parallel partial needed texture 32 is performed in the carriage direction from right to left with the knitting system S1. Subsequently in row 8, the right stitches K, O, S, W, Y are transmitted to the rear needle bed H. In row 9, after a needle bed displacement of the rear needle bed H, a part of the stitches of the parallel partial knitted texture k, m, o, q is transfer to the front needle bed 8 with the first knitting system S1 in the carriage direction from left to right. The stitches of the needle K are transferred to the needle I, the stitches of the needle m are transferred to the needle K, the stitches of the needle o are transferred to the stitches M, and the stitches of the needle q are transferred to the needle O, whereby the expansion of the parallel partial knitted texture 32 is produced.

Subsequently the rear needle bed H is displaced back, and in row 10 the left stitches K, O are transfer from the front needle bed V to the rear needle bed H, and the right stitches s, w, y are transfer from the rear needle bed H to the front needle bed V. In row 11 left and right stitches are formed from the parallel partial knitted structures 32 in the carriage direction from left to right with the first knitting system S1.

The needle q forms additionally a tuck loop, which provides a marking of the limiting line between the offset stitches and the non offset stitches, see line 33 in FIG. 5. In row 12 in the same knitting direction all stitches which are located on the rear needle bed, or in other words all stitches of the base knitted texture 31 as well as the left stitches k, o, u of the parallel partial knitted texture 32 are transfer to the front needle bed D. In row 13 a stitch row for the base knitted texture 31 is again formed in the carriage direction from right to left with the first knitting system S1. Subsequently the steps of the rows 5–13 can be repeated until the desired expansion of the parallel partial knitted texture 32 is obtained.

The rows 14–22 show the production of a region M of the reverse collar 32 with a reduction of the knitting width. In row 15 a stitch row for the base knitted texture 31 is formed in the knitting direction from left to right with the first knitting system S1 on the front needle bed 8. Subsequently, in the same carriage direction all stitches of the base knitted texture 31 and the link stitches I, M, Q, U of the parallel partial knitted texture 32 are transferred in the same carriage direction with the knitting system S2 in row 15. After this, in row 16, left and right stitches for the parallel partial knitted texture 32 are formed with the first knitting system S1. The needle Y carries the connecting stitches for the base flat knitted texture 31. In row 17 also right stitches G, K are produced from right to left with the knitting system S2 on the left edge of the parallel partial knitted texture 32 from the front needle bed V to the rear needle bed H, and the light stitches q, u are hang over at the right edge of the partial knitted texture 32 from the front needle bed V to the rear needle bed H, and left stitches q, u are transfer on the right edge of the partial knitted texture 32 from the rear needle bed H to the front needle bed V. Then only those stitches g, i, k, m are located on the rear needle bed H, which participate in the subsequent reduction process. For this purpose, the rear needle bed H is displaced, and subsequently in row 18 with the first knitting system S1 in the carriage direction from left to right the stitches of the needle q is transfer to the needle K, the stitch of the needle i is transfer on the needle m and the stitch of the needle k is transfer to the needle o of the front needle bed V. With this hanging over process the reduction of the width of the parallel partial knitted texture 32 is performed. Subsequently in row 19 after a reverse displacement of the rear needle bed H, a hanging over of the left stitches M, Q, U of the parallel partial knitted structure 32 is performed from the front needle bed V to the rear needle bed H, and before in row 20 in the carriage direction from left to right left and right stitches are formed with the first knitting system S1 for the parallel partial knitted texture 32. Subsequently in row 21 all stitches of the rear needle bed H, or in other words, all stitches of the base knitted texture 31 as well as the left stitches m, q, u of the parallel partial knitted texture 32 are transferred to the front needle bed V. Then in row 22 a stitch row is formed on the front needle bed V for the base knitted texture 31. Also, the steps of the rows 14–22 can be repeated until the region M of the parallel partial knitted texture 32 is reduced to the desired width.

The examples of the base knitted textures with parallel partial knitted textures shown in the drawings are however only exemplary. With the inventive method a plurality of further combinations of the base knitted textures and parallel partial knitted textures can be produced.

It will be understood that each of the elements described above, or two or more together, may also find a useful application in other types of methods differing from the types described above.

While the invention has been illustrated and described as embodied in method for producing a knitted article on a flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A method for producing a knitted article on a flat knitting machine with two opposite needle beds and a stitch transfer device, comprising the steps of providing a knitted article with a base knitted structure and at least one parallel partial knitted texture which partially overlaps the base knitted structure; equipping at least in a region of the parallel partial knitted structure at most each second needle of one needle bed with a stitch of the base knitted texture; emptying a needle of another needle bed which is opposite to the equipped needle of the one needle bed; producing stitches of at least one parallel partial knitted texture in needles which are not equipped with base knitting stitches; transferring stitches of the base knitted texture in a region of at least one parallel partial knitted texture before producing stitches for the parallel partial knitted texture on the another needle bed.

2. A method as defined in claim 1; and further comprising the step of connecting the parallel partial knitted texture with the base knitted texture.

3. A method as defined in claim 2, wherein said connecting includes connecting the parallel partial knitted texture by tuck loops with the base knitted texture.

4. A method as defined in claim 2, wherein said connecting includes connecting the parallel partial knitted texture by stitches with the base knitted texture.

5. A method as defined in claim 1; and further comprising the step of providing at least one parallel partial knitted texture with a rib knitted texture region, said providing the at least one parallel partial knitted texture with the rib knitted texture region including the steps of transferring base knitting stitches and left stitches of the parallel partial knitted texture to a rear needle bed, subsequently producing left and right stitches for the parallel partial knitted texture, transferring back the base knitting stitches and the left stitches of the parallel partial knitted texture to a front needle bed, forming a stitch row for the base knitted texture and repeating the above mentioned steps until a desired number of stitch rows for the parallel partial knitted texture is produced.

6. A method as defined in claim 1; and further comprising the step of forming at least one parallel partial knitted texture as a strip-shaped plane right knitted structure which alternates on a front and a rear side of a smooth left knitted base knitted structure, wherein said forming including the steps of producing a stitch row for the base knitted texture on the rear needle bed, producing a stitch row for the parallel partial knitted texture on a front needle bed, repeating these steps until a parallel partial knitted texture of a desired height is produced on the front side of the base knitted structure, transferring the stitches of the parallel partial knitted structure to the rear needle bed, producing a stitch row for the base knitted structure on the rear needle bed, transferring the base knitting stitches in the region of the parallel partial knitted texture on the front needle bed, forming a stitch row for the parallel partial knitted texture on the rear needle bed, transferring back the base knitting stitches on the rear needle bed, repeating the preceding steps until the parallel partial knitted texture reaches on a rear side of the base knitted textures a desired height, transferring the stitches of the parallel partial knitted texture on the front needle bed, repeating all preceding steps until a knitted article of a desired length is obtained.

7. A method as defined in claim 1; and further comprising the step of forming the parallel partial knitted texture as a right-right knitted texture with regions of constant knitting width, regions of a knitting expansion and regions of a knitting width reduction produced parallel to a smooth right knitted base knitted structure, said forming including the steps of first producing regions of constant width for the parallel partial knitted structure by producing a stitch row for the base knitted textures on a front needle bed transferring the base knitting stitches in regions of parallel partial knitted textures and left stitches of the parallel partial knitted texture on a rear needle bed, forming right and left stitches for the parallel partial knitted texture, transferring the base knitting stitches and the left stitches of the parallel partial knitted texture on the front needle bed, repeating the above mentioned steps until a region of the parallel partial knitted texture with a desired height is obtained; producing the regions with a knitting expansion of the parallel partial knitted structure at a distance from an edge of the parallel partial knitted structure by producing a stitch row for the base needed texture on the front needle bed, transferring the base knitting stitches and left stitches of the parallel partial knitted texture on a rear needle bed, forming right and left stitches for the parallel partial knitted texture, transferring right stitches of the parallel partial knitted texture on the rear needle bed, displacing of the rear needle bed to the left, transferring a part of the stitches of the parallel partial knitted texture from the rear needle bed to the front needle bed, back moving of the rear needle bed, transferring the left stitches of the parallel partial knitted texture on the rear needle bed and the right stitches on the front needle bed, knitting of right and left stitches for the parallel partial knitted texture, transferring the base knitted stitches and the left stitches of the parallel partial knitted texture on the front needle bed, and repeating the preceding steps until the desired knitting expansion is obtained; for producing regions with knitting width reduction of the parallel partial knitted texture at a distance from an edge of the parallel partial knitted texture performing the steps of forming a stitch row for the base knitted texture on the front needle bed, transferring the base knitting stitches and the left stitches of the parallel partial knitted texture on the rear needle bed, forming right and left stitches for the parallel partial knitted texture, transferring the right stitches on a left outer edge of the parallel partial knitted texture from the front needle bed to the rear needle bed and the left stitches from the rear needle bed to the front needle bed, so that only stitches of the parallel partial knitted structure participating in a reduction process hang on the rear needle bed, displacing the rear needle bed to the right, transferring the stitches of the parallel partial knitted texture which participate in a reduction process from the rear needle bed to the front needle bed, reversely displacing the rear needle bed, transferring the left stitches of the parallel partial knitted texture on the rear needle bed, forming left and right stitches for the parallel partial knitted texture, transferring the base knitting stitches and the left stitches of the parallel partial knitted texture on the front needle bed; and repeating the steps until a desired width reduction of the parallel partial knitted texture is obtained.

* * * * *